United States Patent [19]

Barlow et al.

[11] 4,229,005

[45] Oct. 21, 1980

[54] TRACK RACING GAME

[75] Inventors: Gordon A. Barlow, Evanston; Anthony T. Janiszewski, Elmwood Park; John R. Krutsch, Glenview, all of Ill.

[73] Assignee: Gordon Barlow Design, Skokie, Ill.

[21] Appl. No.: 969,584

[22] Filed: Dec. 14, 1978

[51] Int. Cl.[3] ..... A63F 9/14

[52] U.S. Cl. ..... 273/86 D; 46/44; 46/206

[58] Field of Search ..... 273/86 R, 86 D; 46/202, 46/206, 44

[56] References Cited

U.S. PATENT DOCUMENTS

| | | | |
|---|---|---|---|
| 3,469,340 | 9/1969 | Breneman et al. | 46/44 |
| 3,697,071 | 10/1972 | Anderson | 273/86 D |
| 3,860,237 | 1/1975 | Cooper et al. | 273/86 R |
| 3,877,169 | 4/1975 | Munday et al. | 46/206 X |

*Primary Examiner*—Anton O. Oechsle

*Attorney, Agent, or Firm*—Alter and Weiss

[57] ABSTRACT

A pair of racing cars are individually propelled on tracks by impulses of air initiated by individual pumps at speeds that are a function of the individual operation of the air pumps. The propulsion portion of the tracks are enclosed and the rest of the track is opened and designed to enable one car to pass the other. A unique pin and groove system returns each car to its own starting point.

9 Claims, 8 Drawing Figures

TRACK RACING GAME

This invention is generally concerned with game devices; and more particularly, to miniature automobile track racing games.

Racing games have always been popular. Since the introduction of the automobile, automobile racing games have been popular. There are a plethora of different types of racing games available in the marketplace. some use spring-type motors for driving the vehicles; some use electrical motors for driving the vehicles; others use inertia propelled automobiles.

Also there are many different types of track arrangements available, including totally enclosed tracks, totally open tracks and combinations of the two. The tracks, for the most part, include the means for steering the cars back to the starting point.

Most prior art air propelled racing car arrangements do not rely solely on an impulse system; but, instead provide streams of air at many points on the track to continue the propulsion of the cars.

There is a prior art U.S. Pat. No. 3,469,340, which issued to J. L. Breneman, et al. on Sept. 30, 1969, which uses an air impulse propulsion system. The Breneman, et al. system is used to propel a single toy vehicle through a tube substantially for the complete travelled distance. Breneman, et al. use a complicated arrangement of one-way or check valves in the path of the vehicle in the tube, in addition to the intake and exhaust valves to insure that impulses are supplied to the vehicle during its trip through the length of the tube. Since only one vehicle is used in a tube arrangement that extends for most of the length that the vehicle travels, there is no problem bringing the individual vehicles back to the original starting point.

Accordingly, an object of the present invention is to provide new and unique automobile racing systems.

A related object of the present invention is to provide automobile racing systems wherein at least two toy automobiles race against each other and are each propelled by individually operated pneumatic pumps.

Another object of the present invention is to provide air propulsion systems wherein individual automobiles race around an open track and receive their impulse and momentum from individual air pumps and wherein the automobiles are automatically directed to return to their original starting points.

Yet another object of the present invention is to provide miniature automobile racing tracks wherein each car on the tracks is provided with its own starting position, in a transparent tube; and wherein automatic steering is provided for directing the cars back to their individual starting tubes, through a manifold section including a plurality of tubes or sections.

A related object of the present invention is to provide downwardly extending right-left split bars in the tube sections for separating the cars and directing the cars back to the starting point.

A preferred embodiment of the present invention comprises an oval open track having an enclosed starting portion divided into individual tubular sections used as the starting point. A clack valve closes off the entrance of each section. Individual pump means are coupled to each section. A pair of replica automobiles with spoilers at the rear ends which substantially fill the tubular section are provided.

At the entrance to the individual starting sections, prior to the clack valve, a downwardly extending right-left split bar is provided to aid in directing the individual automobiles back to their starting points. In addition, track means are provided in the starting sections to assure a non-traversing start.

Track riding means are provided on each of the automobiles. More particularly, pins extend upward from either the left side or the right side of the automobiles. The cars with the pins on the left side are forced by the right-left split bars to the left side; and the cars with the pins on the right side are forced by the right-left split bars to the right side. Once inside the starting section, the pins mesh with grooves at the top of the sections. The automobiles are propelled when the individual hand-operated pumps are used by the players.

The above-mentioned and other objects and features of the present invention will be best understood by making reference to the accompanying drawings; wherein.

Figure 1:
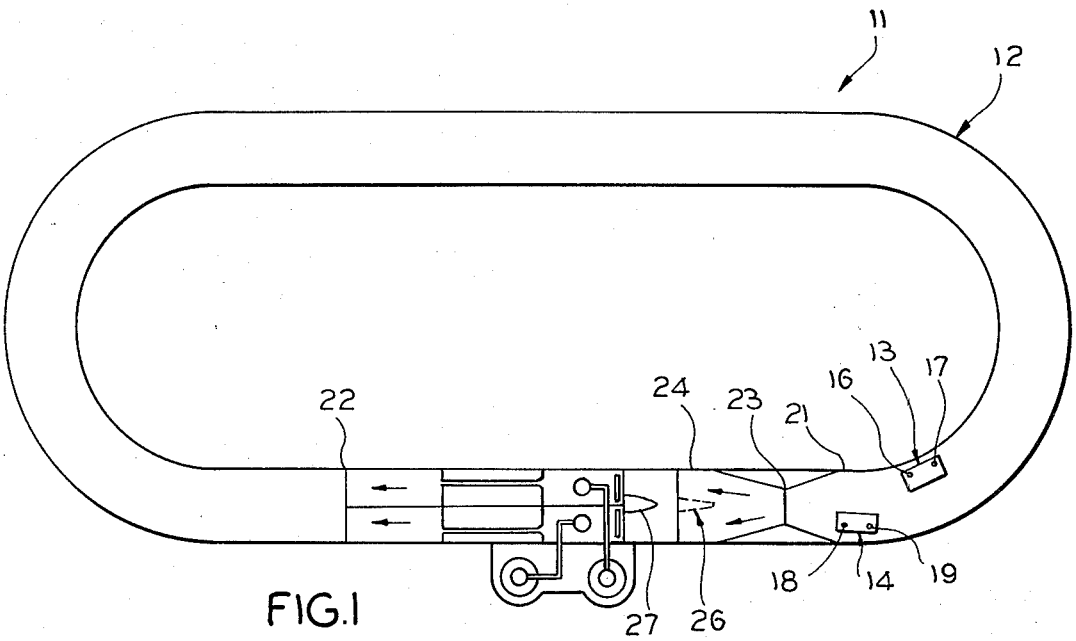
FIG. 1 is a schematic plan view of the track racing game.
Figure 2:
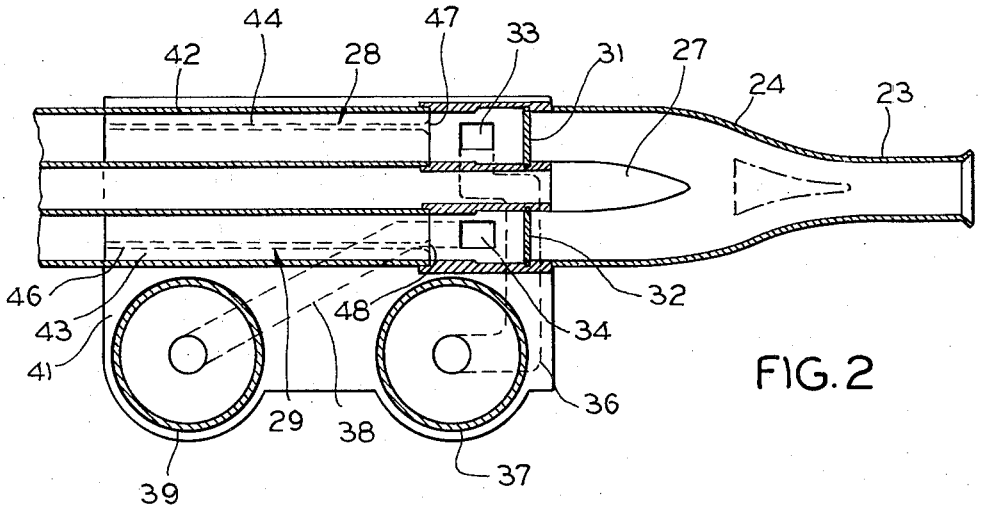
FIG. 2 is a partial sectional view of the starting section of the track racing game shown in FIG. 1.

In FIG. 1 a track racing game 11 is shown as comprising an open track 12 utilized by a pair of miniature racing cars, schematically shown as cars 13 and 14. Each of the cars is shown as being equipped with starting or propulsion section selecting means. For example, automobile 13 has upstanding posts 16 and 17; while automobile 14 has upstanding posts 18 and 19. The upstanding posts, it is noted, are longitudinally aligned on opposite sides of the automobile. Thus, the upstanding posts 16 and 17 are shown as being on the inner side of automobile 13 relative to the track; while upstanding posts 18 and 19 are shown as being on the outer side of automobile 14 relative to the track.

Most of the track 12 is open. However, a portion of the track extending from inlet 21 to outlet 22 is enclosed by a transparent tubing arrangement. As shown, the tubing arrangement, starting at entrance 21, funnels to a narrow neck portion 23, after which the tube flares at a dual tube entrance portion 24.

A right-left split curb 26 extending downwardly from the top of the tubing is centrally located along the central longitudinal axis of the tubing. The right-left split curb acts in cooperation with the upstanding posts 16, 17 and 18, 19 to direct the cars either to the right or to the left impulse section.

An upwardly extending curb section 27 is part of the defining boundary of the entrance to the impulse or starting sections 28 and 29. Means are provided at each of the starting sections 28 and 29 to cause air directed into the sections to flow unidirectionally. More particularly, each impulse section has a door 31 and 32 which can only open inward into the impulse section. Thus, the doors 31 and 32 act as clack valves relative to air coming from the air input openings 33 and 34. Opening 33 is the end of air passage 36 which leads directly to pump 37; while opening 34 is the entrance to air passage 38 leading to pump 39. Pumps 37 and 39 are shown adjacent the outer impulse section 29.

Means are provided for assuring that the miniature racing cars are properly oriented; i.e., facing directly forward at the start. More particularly, the impulse sections 28 and 29 integrally include orienting tubes 42 and 43, respectively. The orienting tubes each have a single groove or track therein, at the top portions thereof, such as track 44 in orienting tube 42 and track 46 in orienting tube 43, shown in FIG. 3. The tracks are grooves in the tops of the tubes receive the upstanding posts of the automobiles. To facilitate the receipt of the posts, the entrances to the grooves 44, 46 are flared, as shown at 47 and 48 at the beginnings of orienting tubes 42 and 43, respectively.

Figure 4:
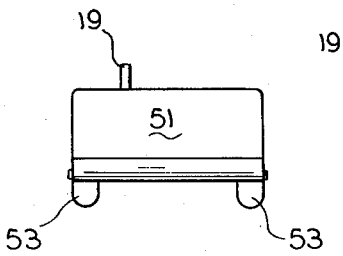
FIG. 4 is a rear view of the automobile of FIG. 3.
Figure 3:
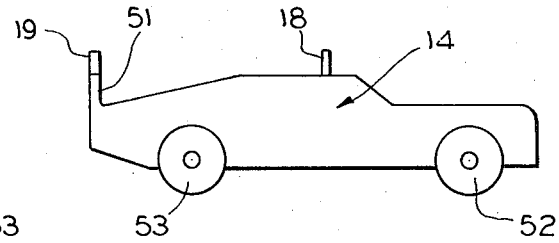
FIG. 3 is a side view of a typical, miniature, replica automobile used in the track racing game.

The automobiles, such as automobile 14, are replicas of stock cars and have spoilers at the rear end thereof, such as spoiler 51. The spoiler 51, as shown in FIG. 4, is rectangular in shape. However, it should be understood that the spoiler is preferably shaped to approximate any shape the starting section may have so as to provide a maximum trappage of air between the spoiler 51 and the clack valve door 32, for example. The upstanding posts 18 and 19, as shown in FIGS. 3 and 4, are both located on the same side of the automobile.

In a preferred embodiment of the track racing game, the automobiles have free turning rubber tired wheels 52 and 53. Preferably, the wheels are mounted so as to be as friction-free as possible to enable the automobiles to speed around the track, after being ejected from the impulse tube by an initial blast of air.

The open track itself is preferably banked to enable the automobiles to traverse the track in the most efficient manner with the least amount of side skidding. The track is sufficiently wide to enable the automobile that receives the stronger impulse to pass the other automobile.

Figure 5:
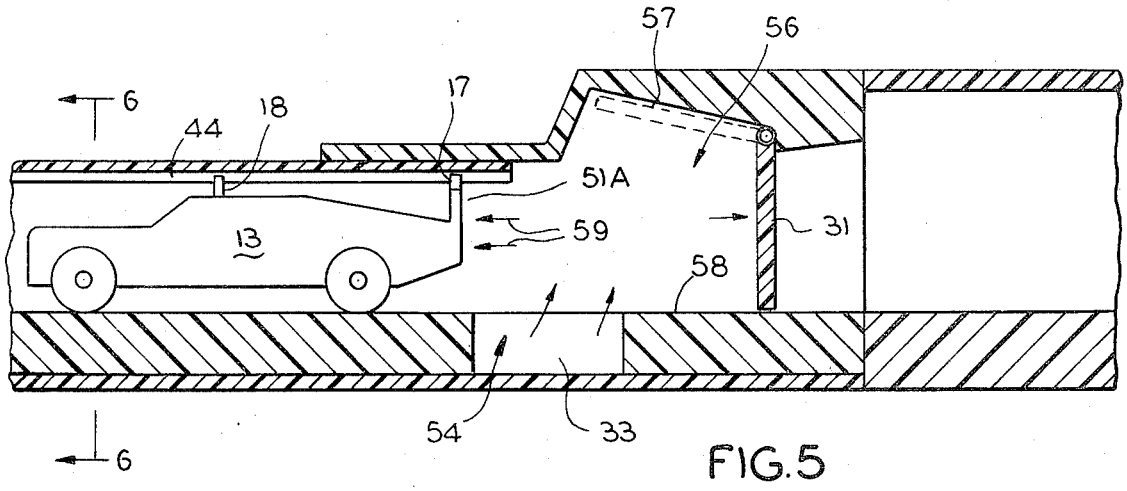
FIG. 5 is a side sectional view of a portion of the starting section with the automobile in place.
Figure 7:
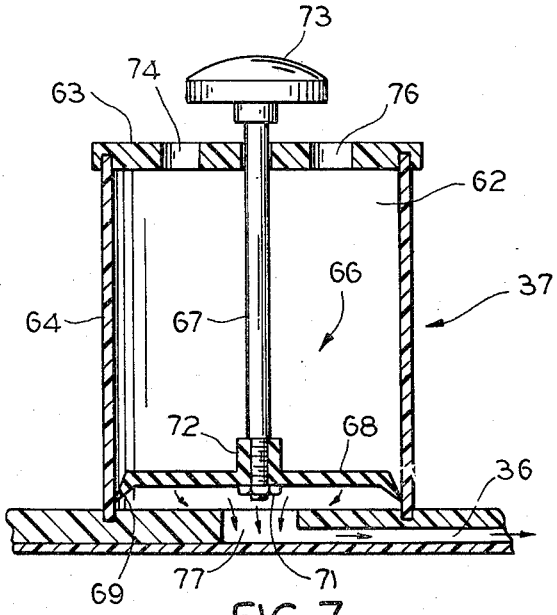
FIG. 7 is a sectional view of one hand pump used for propelling the automobiles from the starting section.

FIG. 5 shows a racing car 13 with the spoiler 51A in position in the orienting tube 43 of starting or impulse section 29 to receive the initial impulse or blast of air to propel it around the track. The cars, for example car 13, are oriented directly forward by upstanding posts 17 and 18, meshed in groove 44. This assures that car 13 is properly aligned and in the best position for receiving a maximum impulse responsive to the blasts of air coming from opening 33. The air is depicted by the showing of arrows 54. The arrows 54 are shown pointing upward indicating the direction the air flows originally, when coming from opening 33.

The air is confined in air blast chamber 56 of the starting section 29. Chamber 56 is entered through clack valve door 31. The ceiling 57 of chamber 56 is designed to receive clack door 31 responsive to the entrance of the car 13 into the impulse tube. The chamber 56 has a floor 58. The spoiler 51A plugs the chamber 56 until the air forces the car from tube 43.

The air entering the chamber 56 applies a force to the spoiler approximately equal to the pressure of the air times the area of the spoiler. The force against the spoiler indicated by arrows 59 ejects the automobile 13 from the impulse section 28 at a maximum speed.

Figure 6:
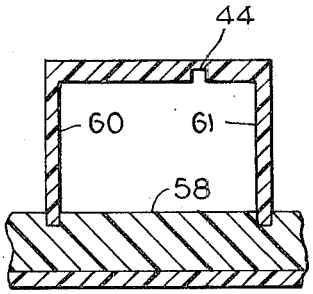
FIG. 6 is a front sectional view of the starting section taken along lines 6—6 of FIG. 5, and looking in the direction of the arrows 6—6.

FIG. 6 shows walls 60 and 61 of tube 42 and the groove 44, which receives the pins 17 and 18, to assure the proper alignment of the automobile during the initial impulse of the air received from the pump 37. It should be understood that while FIG. 6 shows the orienting tube as rectangularly shaped, it could just as easily assume a cylindrical shape without any change in the invention.

The pump 37 is shown as comprising a pump chamber 62 defined by an upper cover 63 over cylinder 64. A piston 66 comprises a rod 67 and a piston cylinder 68. The piston cylinder 68 preferably has a lip section, such as lip section 69, which assures a tight fit between cylinder 68 and the inner walls of the chamber 62. The cylinder 68 is attached to the rod in any well known manner, such as for example using nut fastener 71 on the threaded end 72 of rod 67. The rod 67 is shown as having a compression handle 73 affixed thereto in any well known manner.

Means are provided to facilitate lifting up the piston. More particularly, air apertures 74 and 76 are provided on the cover 63 of the air cylinder 37.

When the piston moves down, it drives most of the air from the chamber 62 into the air passage 36 through air passage entrance 77. The air from air passage 36 impells the automobile in the impulse section around the track and back to the impulse section.

Figure 8:
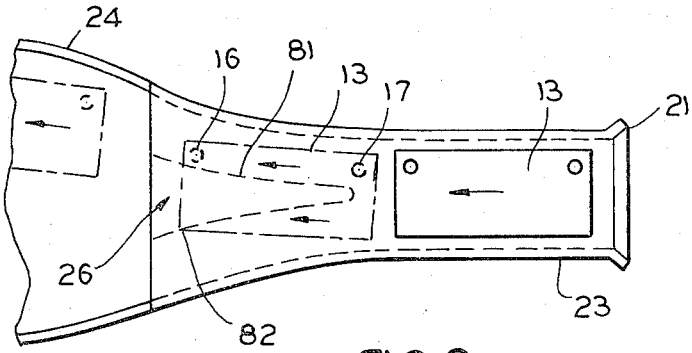
FIG. 8 is a stop-action view of a portion of the inlet to the starting section showing the affect of the automobile split curb on one of the returning automobiles.

FIG. 8 shows in greater detail how the upstanding posts, such as posts 16 and 17 of car 13, act to direct the car to the proper impulse section. As the spoiler car 13 races through the neck section 23, immediately beyond the entrance 21, the posts strike the downwardly extending curb wall 81 of curb 26. The curb wall forces the car towards the inside portion of the tube section 24 and the inertia of the car directs it through clack valve door 31 into the impulse section, where the pins 16 and 17 automatically enter the groove 28 at the top of the orienting tube.

When automobile 14 enters the neck portion 23 of the entrance tube, then its pins 18 and 19 strike wall 82 of curb 26 and force automobile 14 to the outside of the tube through clack valve door 32 so that the pins or posts 18 and 19 enter into the groove 46.

In operation then, each of the two players places his automobile into his respective starting section past the respective air passage openings 33 and 34, with the pins aligned in the grooves of the individual orienting tubes. With the cars in place both players lift up piston rods of their individual pumps; and, at the start signal, both players press on the handle means to force air down through the air passage into the starting chamber to propel their individual automobiles around the track. The first car back to its starting tube wins the race.

The simultaneous propulsion of the cars sets up many interesting situations, including when equal forces are applied by the two players having the cars crash into each other at the neck section 23. More likely, one car is slightly faster due to slightly more propulsion than the other car and passes through the neck portion immediately prior to the second car. The game provides many interesting and varied races between the two cars.

While the principles of the invention have been described above in connection with specific apparatus and applications, it is to be understood that this description is made by way of example only and not as a limitation on the scope of the invention.

We claim:

1. A racing game, said game comprising a track,
racing objects for racing over said track,
said track making a complete circuit,
said track having a starting section transparently enclosed wherein each of the racing objects are laterally positioned abreast of each other,
said track further having a racing section dimensioned to hold at least two racing objects juxtaposed, and
wherein said racing section is unobstructed so that each racing object is free to laterally traverse the said racing section,
said starting section further comprises entrance means for receiving said racing objects from said racing section,
said entrance means leading to an impluse chamber for each of said racing objects,
impulse means in said impulse chamber for providing forces to said racing objects to propell said racing objects over said racing section,
said impulse chamber leading directly to an orienting portion, and
means in said orienting portion for maintaining said racing objects directed straight forward.

2. The racing game of claim 1 wherein said impulse chamber is separated from said entrance means by one-way valve means, and
means for automatically directing each of said racing objects back to the lateral position of each of said racing objects in the starting section.

3. The racing game of claim 2 wherein
said entrance means comprises a neck portion sufficiently wide to accomodate only one of the racing objects at a time.

4. The racing game of claim 3 wherein said means for directing said racing objects comprises a right-left split curb downwardly depending from the top of said enclosure.

5. The racing game of claim 4 wherein the right-left split curb comes immediately after said neck portion, and
a pair of upwardly extending pins linearly aligned on opposite sides of said at least two racing objects, whereby when said pins tangentially strike said curbs, the racing objects are directed to the right or to the left.

6. A racing game,
said racing game comprising a track,
said track making a complete circuit and being dimensioned to hold at least two racing objects juxtaposed,
said track having an enclosed starting section wherein each of the racing objects are positioned abreast of each other,
said enclosure being transparent,
said starting section further comprising entrance means for receiving said racing objects,
said entrance means leading to an impulse chamber for each of said racing objects,
force providing means in said impulse chamber for providing forces to said racing objects to propell them over said track,
said impulse chamber separated from said entrance means by one-way valve means,
each of said impulse chambers leading directly to an orienting portion for maintaining said racing objects directed forward, and
means for automatically directing each of said racing objects back to the position of each of said racing objects in the starting section.

7. The racing game of claim 6 wherein said force providing means comprises hand-operated air pump means for each impulse chamber, and
means for individually connecting said air pump means to each impulse chamber.

8. The racing game of claim 7 including means on each of said racing objects to block said impulse chambers and thereby obtain a maximum propulsion from the flow of the air into said impulse chambers.

9. A racing game,
said game comprising a track,
racing objects for racing over said track,
said track making a complete circuit and being dimensioned to hold at least two of said racing objects abreast,
said track having an enclosed starting section wherein each of the racing objects is positioned abreast of each other,
said enclosure being transparent,
propulsion means at said starting section for providing forces to said racing objects to propell said racing objects over said track,
said starting section comprising entrance means for receiving said racing objects,
said entrance means leading to an impulse chamber for each of said racing objects,
said impulse chamber separated from said entrance means by one-way valve means,
said entrance means comprising a neck sufficiently wide to accomodate only one of the racing objects at a time,
a right-left split curb downwardly depending from the top of said enclosure for directing said racing objects back to the original position of the racing objects in the starting section,
said right-left split curb located immediately following said neck,
a pair of upwardly extending pins linearly aligned on opposite ends of each of said at least two racing objects, whereby when said pins tangentially strike said curb, the objects are directed to the right or to the left,
said starting section including orienting sections following said impulse sections,
said orienting sections each including a groove at the top thereof to receive the upwardly extending pins of said racing objects to thereby align said racing objects straight forward.

* * * * *